US011359375B2

(12) United States Patent
Chuang

(10) Patent No.: US 11,359,375 B2
(45) Date of Patent: Jun. 14, 2022

(54) ENHANCED NON-COPLANAR DOUBLE WINDING REINFORCEMENT METHOD, STRUCTURE BUILT BY THE SAME, AND CROSSTIE FOR THE SAME

(71) Applicant: Hsun-Jen Chuang, Taipei (TW)

(72) Inventor: Kuo-Jung Chuang, Taipei (TW)

(73) Assignee: Hsun-Jen Chuang, Taipei (TW)

( * ) Notice: Subject to any disclaimer, the term of this patent is extended or adjusted under 35 U.S.C. 154(b) by 0 days.

(21) Appl. No.: 17/182,236

(22) Filed: Feb. 23, 2021

(65) Prior Publication Data

US 2022/0081905 A1 Mar. 17, 2022

(30) Foreign Application Priority Data

Sep. 14, 2020 (TW) ..... 109131495

(51) Int. Cl.
*E04C 5/06* (2006.01)

(52) U.S. Cl.
CPC ..... *E04C 5/0622* (2013.01)

(58) Field of Classification Search
CPC ..... E04C 3/34; E04C 5/0604; E04C 5/0609; E04C 5/0618; E04C 5/0622; E04C 5/0636; E04C 5/166
See application file for complete search history.

(56) References Cited

U.S. PATENT DOCUMENTS 3,375,632 A * 4/1968 Congy ..... E04C 5/0609 52/649.3
3,722,164 A * 3/1973 Schmidgall ..... E04C 5/167 52/684
4,489,528 A * 12/1984 Tolliver ..... E04C 5/168 52/677
4,999,965 A * 3/1991 Schmidgall ..... E04C 5/064 52/649.8
10,584,492 B2 * 3/2020 Chuang ..... E04C 5/166
2004/0237449 A1 * 12/2004 Gulikov ..... E04C 5/0618 52/633

(Continued)

FOREIGN PATENT DOCUMENTS

DE 3938508 A1 * 10/1990 ..... B21F 27/125
JP H06037072 9/1994

(Continued)

*Primary Examiner* — Christine T Cajilig
(74) *Attorney, Agent, or Firm* — Bradley J. Thorson; DeWitt LLP

(57) ABSTRACT

An enhanced non-coplanar double winding reinforcement method has a main reinforcing bars erecting step, a reinforcement stirrup winding step, and a crossties double hooking and confining step. The main reinforcing bars and the reinforcement stirrup can be stably confined by the crossties. No iron wire is needed for bundling. Toughness and aseismatic capability of a structure built by the enhanced non-coplanar double winding reinforcement method is improved. Accordingly, construction steps are simplified and construction efficiency are increased. A first plane defined by a main rod portion and a first hook portion of the crosstie and a second plane defined by the main rod portion and a second hook portion of the crosstie intersect, the second hook portion can pass between two of the main reinforcing bars that are disposed next to each other even when the main reinforcing bars are densely arranged.

16 Claims, 13 Drawing Sheets

(56) References Cited

U.S. PATENT DOCUMENTS

| | | | | |
|---|---|---|---|---|
| 2009/0178356 | A1* | 7/2009 | Baumann | E04C 3/34 52/414 |
| 2009/0235609 | A1* | 9/2009 | Amanuma | E04C 5/0604 52/659 |
| 2016/0251856 | A1* | 9/2016 | Kim | E04C 3/34 52/231 |
| 2019/0078316 | A1* | 3/2019 | Yin | E04B 1/24 |
| 2019/0203472 | A1* | 7/2019 | Chuang | E04C 5/166 |

FOREIGN PATENT DOCUMENTS

| | | | | |
|---|---|---|---|---|
| JP | 09119184 | | 5/1997 | |
| JP | 2013185397 | | 9/2013 | |
| JP | 2019120118 | | 7/2019 | |
| WO | WO-2006075044 | A1 * | 7/2006 | E04C 5/0622 |
| WO | WO-2015147415 | A1 * | 10/2015 | E04C 5/167 |

* cited by examiner

ENHANCED NON-COPLANAR DOUBLE WINDING REINFORCEMENT METHOD, STRUCTURE BUILT BY THE SAME, AND CROSSTIE FOR THE SAME

CROSS-REFERENCE TO RELATED APPLICATIONS

This application is based upon and claims priority under 35 U.S.C. 119 from Taiwan Patent Application No. 109131495 filed on Sep. 14, 2020, which is hereby specifically incorporated herein by this reference thereto.

BACKGROUND OF THE INVENTION

1. Field of the Invention

The present invention relates to a reinforcement method for reinforcing bars in a building construction, especially to an enhanced non-coplanar double winding reinforcement method, a structure built by the method, and a crosstie for the method.

2. Description of the Prior Art(s)

A reinforcement cage in a reinforced concrete (RC) column substantially includes multiple main reinforcing bars, multiple reinforcement stirrups, and multiple crossties. The main purpose of the crossties are to confine the main reinforcing bars, so as to prevent the main reinforcing bars from buckling. Therefore, the main reinforcing bars have to be accurately located at bending corners that are formed on ends of the crossties. Otherwise, a confinement effect to the main reinforcing bars would be affected and thus aseismatic capability of a building would be decreased.

With reference to FIG. 11, a structure built by a conventional coplanar single winding reinforcement method is shown and includes multiple main reinforcing bars 51, a reinforcement stirrup 52, and multiple conventional crossties 53. The main reinforcing bars 51 are vertically disposed and are arranged in a rectangle. The reinforcement stirrup 52 is wound around the main reinforcing bars 51. Each of the conventional crossties 53 horizontally extends between two of the main reinforcing bars 51 that are disposed opposite to each other, is stacked on the reinforcement stirrup 52, and has a main rod portion 533, a first hook portion 531 and a second hook portion 532. The first hook portion 531 is formed on an end of the main rod portion 533, is bent at an angle of 90 degrees, and is hooked to one of the main reinforcing bars 51. The second hook portion 532 is formed on another end of the main rod portion 533, is bent at an angle of 135 degrees, and is hooked to one of the main reinforcing bars 51. Moreover, the main rod portion 533, the first hook portion 531, and the second hook portion 532 are disposed on a same plane.

However, in the structure built by the above-mentioned conventional coplanar single winding reinforcement method, each two of the main reinforcing bars 51 that are disposed opposite to each other are connected and confined by only one crosstie 53. The second hook portion 532 of said crosstie 53 forms a 135-degree full confinement effect on a corresponding one of the main reinforcing bars 51 and the first hook portion 531 of said crosstie 53 only forms a 90-degree half confinement effect on a corresponding one of the main reinforcing bars 51. With further reference to FIG. 12, each of the conventional crossties 53 has a fixed length and some of the main reinforcing bars 51 may be displaced when being installed on a construction site. Thus, as one end of the crosstie 53 confines one main reinforcing bar 51, the other end of the crosstie 53 is unable to confine the main reinforcing bar 51 that is displaced. Consequently, the confinement effect that one crosstie 53 forms on the two main reinforcing bars 51 would be reduced to less than one and a half confinement. Moreover, toughness and aseismatic capability of the structure built by the conventional coplanar single winding reinforcement method cannot meet an expected requirement. In addition, problems of not easy and inefficiency to manually bundle the main reinforcing bars 51 and the cross ties 53 are also caused.

Furthermore, with reference to FIG. 12, as for the conventional crosstie 53 used in the above-mentioned conventional coplanar single winding reinforcement method, a plane defined by the main rod portion 533 and the first hook portion 531 overlaps with a plane defined by the main rod portion 533 and the second hook portion 532. That is, the main rod portion 533, the first hook portion 531 and the second hook portion 532 are disposed on the same plane. Accordingly, a length of the first hook portion 531 that is bent at 90 degrees is equivalent to a width of the conventional crosstie 53, and the length of the first hook portion 531 is generally 8 centimeter (cm) to 10 cm. When the main reinforcing bars 51 are arranged in a denser manner such that a net distance between two adjacent main reinforcing bars 51 is 3 cm to 6 cm, it is difficult for the first hook portion 531 of the conventional crosstie 53 to pass between the two adjacent main reinforcing bars 51.

With further reference to FIG. 13, another structure built by a conventional double winding reinforcement method is shown and includes multiple main reinforcing bars 61, a reinforcement stirrup 62, and multiple conventional crossties 63. The main reinforcing bars 61 are vertically disposed and are arranged in a rectangle. The reinforcement stirrup 62 is wound around the main reinforcing bars 61. Each of the conventional crossties 63 horizontally extends between two of the main reinforcing bars 61 that are disposed opposite to each other, is stacked on the reinforcement stirrup 62, and has a main rod portion 633, a connecting portion 631 and a hook portion 632. The connecting portion 631 is further extended straight from an end of the main rod portion 633, abuts against one of the main reinforcing bars 61, and is bundled with said main reinforcing bar 61 by an iron wire. The hook portion 632 is formed on another end of the main rod portion 633, is bent at an angle of 135 or 180 degrees, and is hooked to one of the main reinforcing bars 61.

In the structure built by the above-mentioned conventional double winding reinforcement method, each two of the main reinforcing bars 61 that are disposed opposite to each other are connected by two of the crossties 63 with the connecting portions 631 of the two crossties 63 connected to the two main reinforcing bars 61 respectively and the hook portions 632 of the two crossties 63 hooked to the two main reinforcing bars 61 respectively. The hook portion 632 of each crosstie 63 forms a 135-degree or a 180-degree full confinement effect on a corresponding one of the main reinforcing bars 61. However, the connecting portion 631 of each crosstie 63 is unable to form any confinement effect on a corresponding one of the main reinforcing bars 61. Therefore, although the confinement effect formed by the conventional double winding reinforcement method has been increased to two confinement, the connecting portion 631 of the crosstie 63 still has to be bundled with the corresponding main reinforcing bar 61 manually by the iron wire.

SUMMARY OF THE INVENTION

The main objective of the present invention is to provide an enhanced non-coplanar double winding reinforcement method, a structure built by the method, and a crosstie for the method. With the enhanced non-coplanar double winding reinforcement method, a maximum axial load of a reinforced concrete (RC) column is increased and toughness of the RC column is improved. The enhanced non-coplanar double winding reinforcement method does not have to be manually performed and is suitable for main reinforcing bars with small spacing.

The enhanced non-coplanar double winding reinforcement method includes a main reinforcing bars erecting step, a reinforcement stirrup winding step, and a crossties double hooking and confining step. In the main reinforcing bars erecting step, multiple main reinforcing bars are vertically disposed and are separately arranged annularly. In the reinforcement stirrup winding step, a reinforcement stirrup is horizontally wound around the main reinforcing bars. In the crossties double hooking and confining step, multiple crossties are prepared. Each of the crossties has a main rod portion, a first extension rod formed on an end of the main rod portion and bent relative to the main rod portion and a second extension rod formed on another end of the main rod portion and bent relative to the main rod portion. A first plane defined by the main rod portion and the first extension rod and a second plane defined by the main rod portion and the second extension rod intersect and are non-coplanar. The first extension rod is placed on the reinforcement stirrup, is disposed by a lateral side of a corresponding one of the main reinforcing bars and is tilted to be hooked to the corresponding main reinforcing bar and the reinforcement stirrup. The second extension rod passes between two of the main reinforcing bars that are disposed next to each other and is hooked to the reinforcement stirrup.

With the first extension rod of each crosstie hooked to the reinforcement stirrup and the corresponding main reinforcing bar at the same time, a stable and full confinement effect can be formed. With the second extension rod of each crosstie hooked to the reinforcement stirrup, no iron wire is needed for bundling. Toughness and aseismatic capability of the enhanced non-coplanar double winding reinforcement structure is improved. Accordingly, construction steps are simplified and construction efficiency are increased.

Moreover, since the first plane defined by the main rod portion and the first extension rod of the crosstie and the second plane defined by the main rod portion and the second extension rod of the crosstie intersect, the second extension rod can pass between two of the main reinforcing bars that are disposed next to each other even when the main reinforcing bars are densely arranged.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
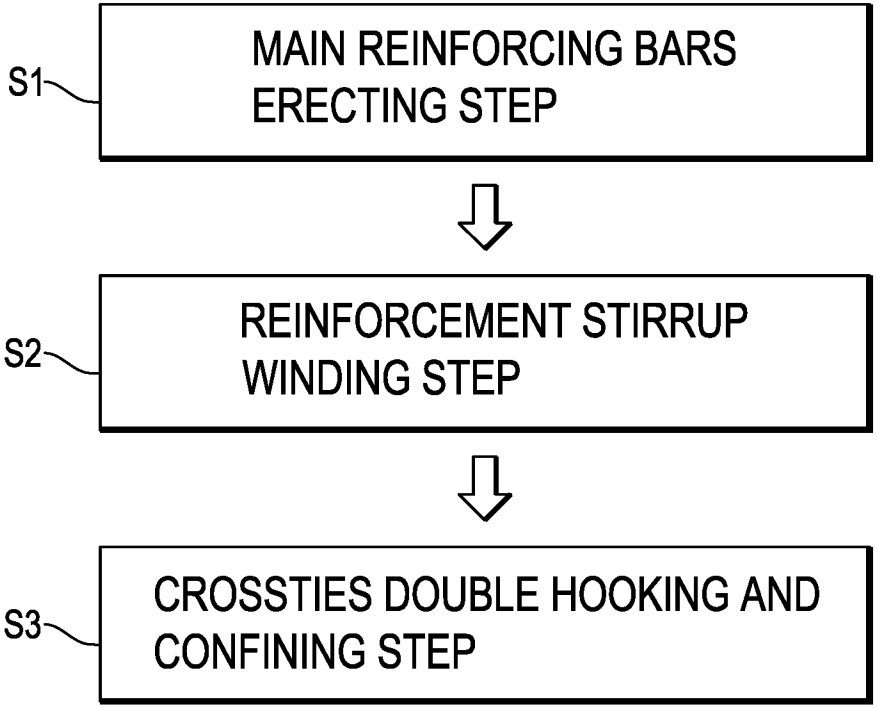
FIG. 1 is a block diagram of an enhanced non-coplanar double winding reinforcement method in accordance with the present invention.

With reference to FIG. 1, an enhanced non-coplanar double winding reinforcement method in accordance with the present invention comprises the following steps: a main reinforcing bars erecting step S1, a reinforcement stirrup winding step S2, and a crossties double hooking and confining step S3.

Figure 2:
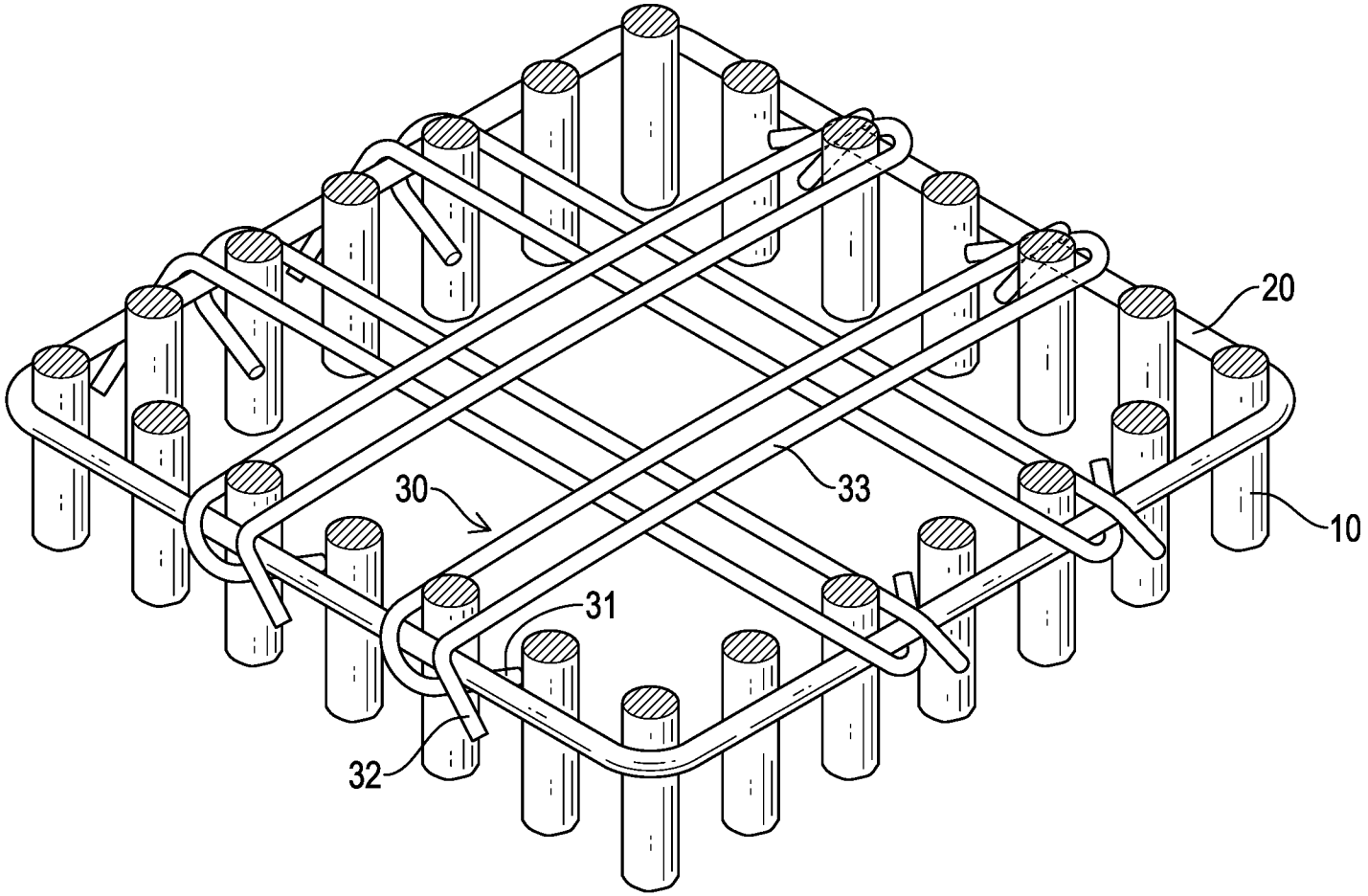
FIG. 2 is an enlarged perspective view of an enhanced non-coplanar double winding reinforcement structure in accordance with the present invention, showing a first embodiment of a crosstie in accordance with the present invention is used.
Figure 3:
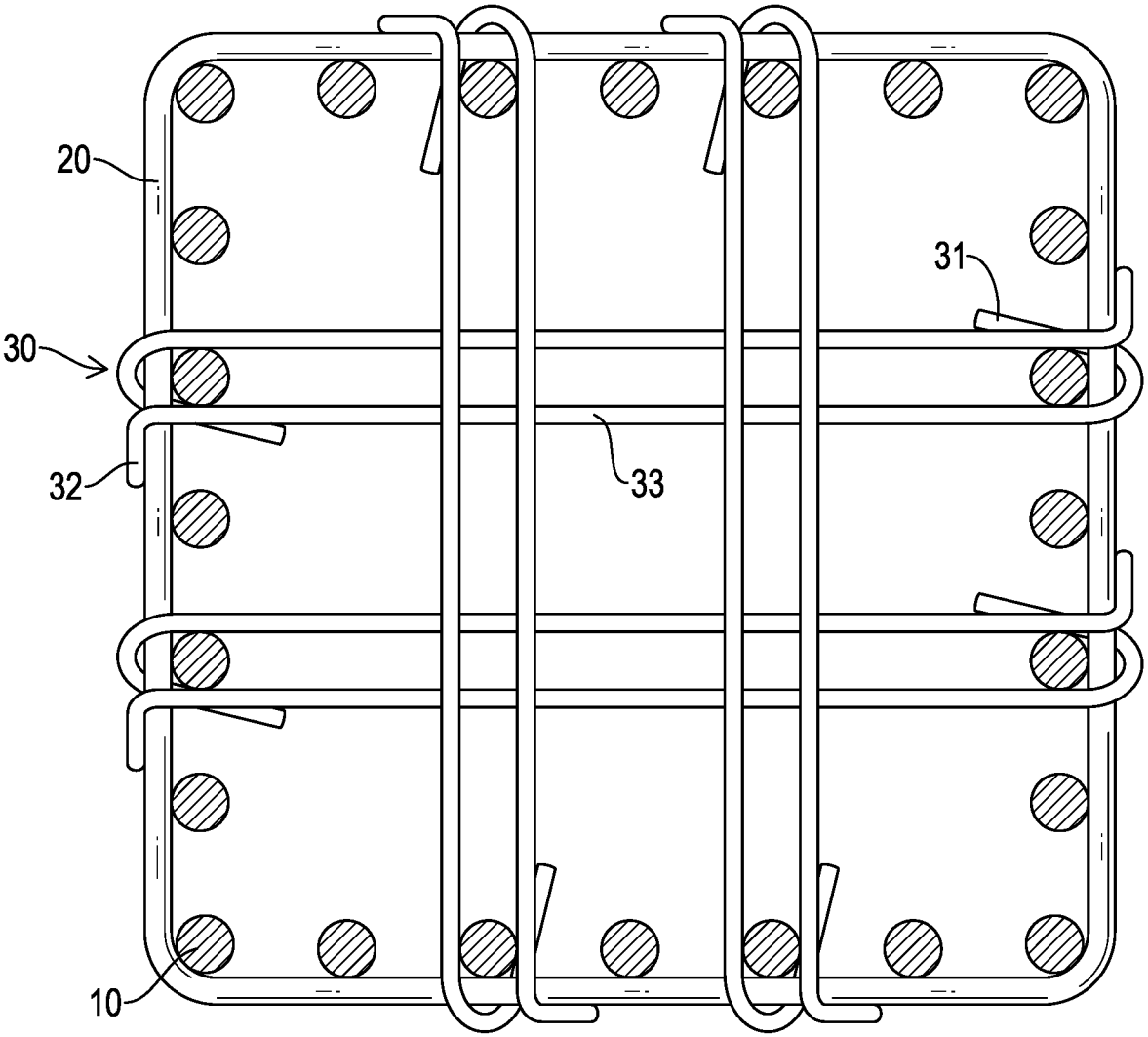
FIG. 3 is a top view of the enhanced non-coplanar double winding reinforcement structure in FIG. 2.
Figure 4:
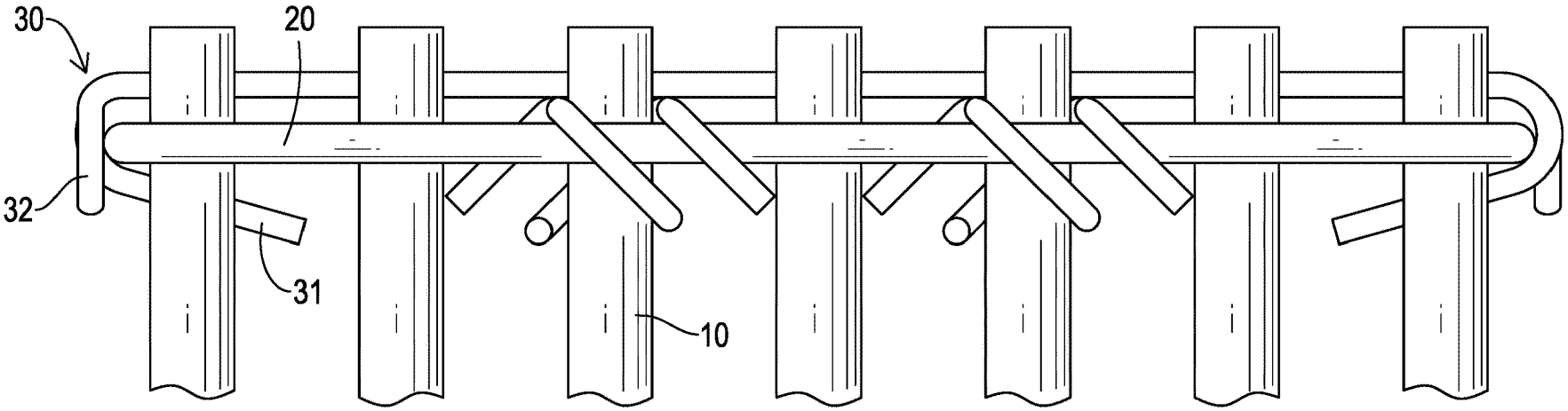
FIG. 4 is a side view of the enhanced non-coplanar double winding reinforcement structure in FIG. 2.
Figure 5:
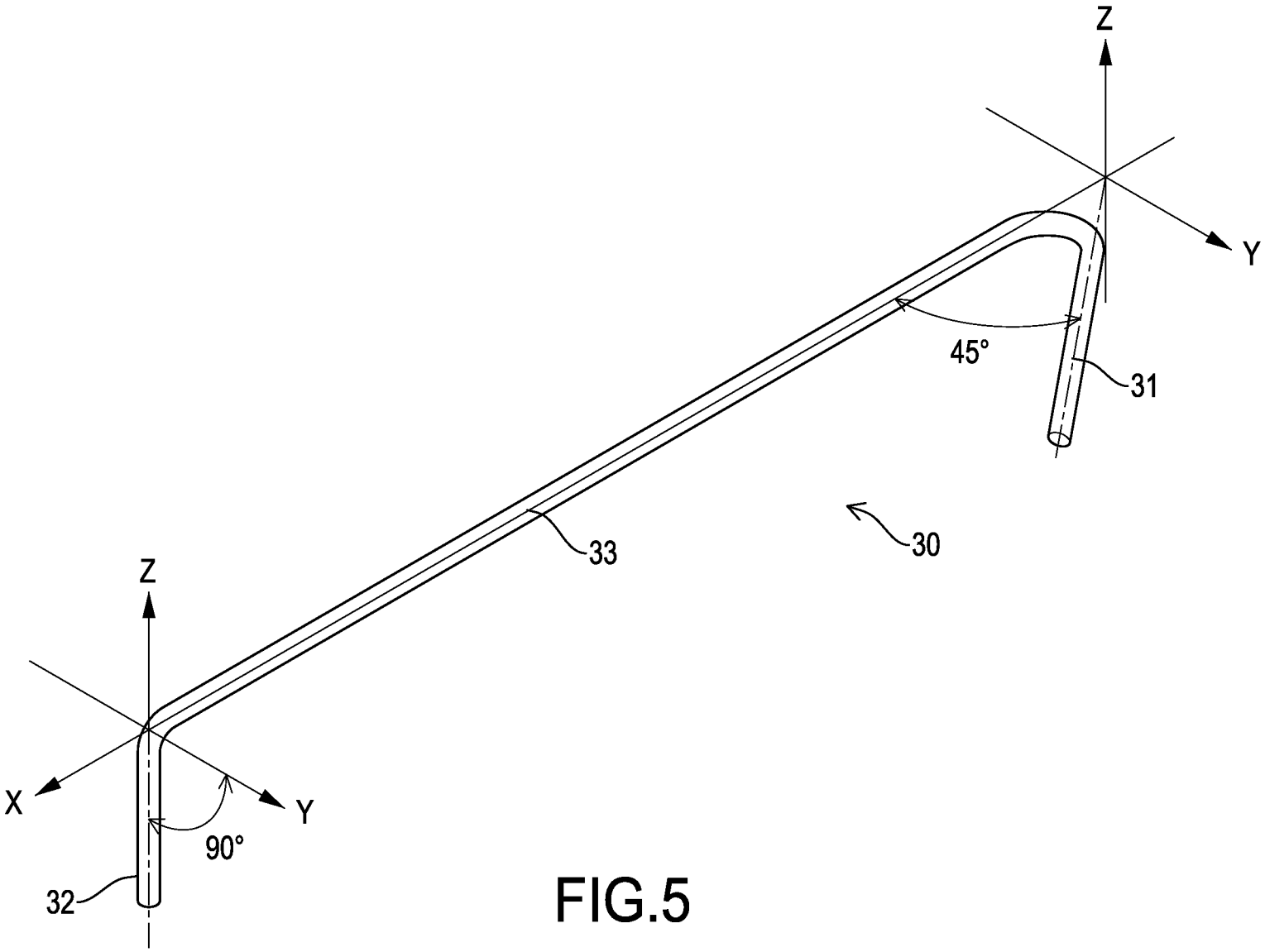
FIG. 5 is a perspective view of the first embodiment of the crosstie used in the enhanced non-coplanar double winding reinforcement structure in FIG. 2.
Figure 6:
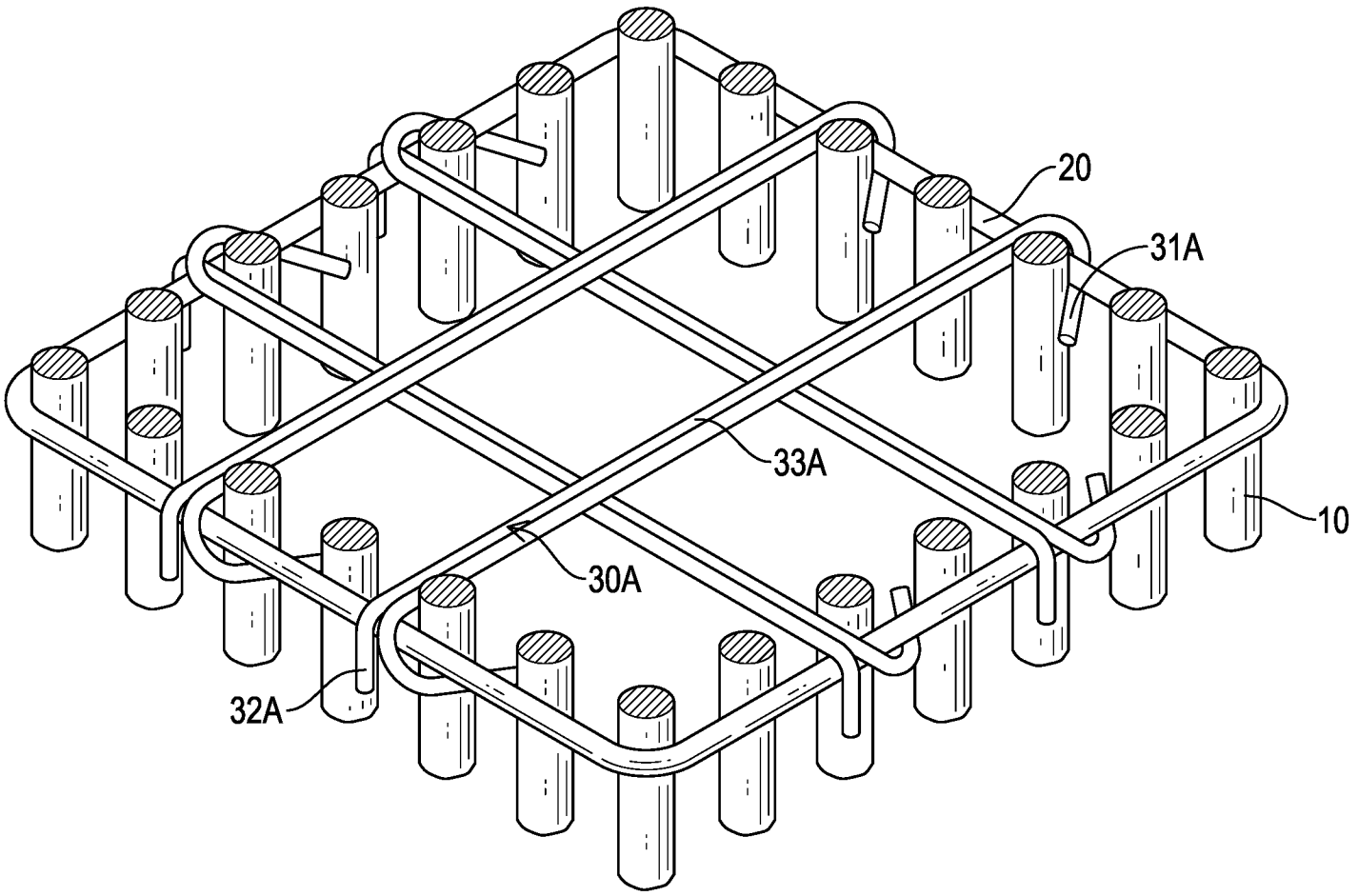
FIG. 6 is an enlarged perspective view of an enhanced non-coplanar double winding reinforcement structure in accordance with the present invention, showing a second embodiment of a crosstie in accordance with the present invention is used.
Figure 7:
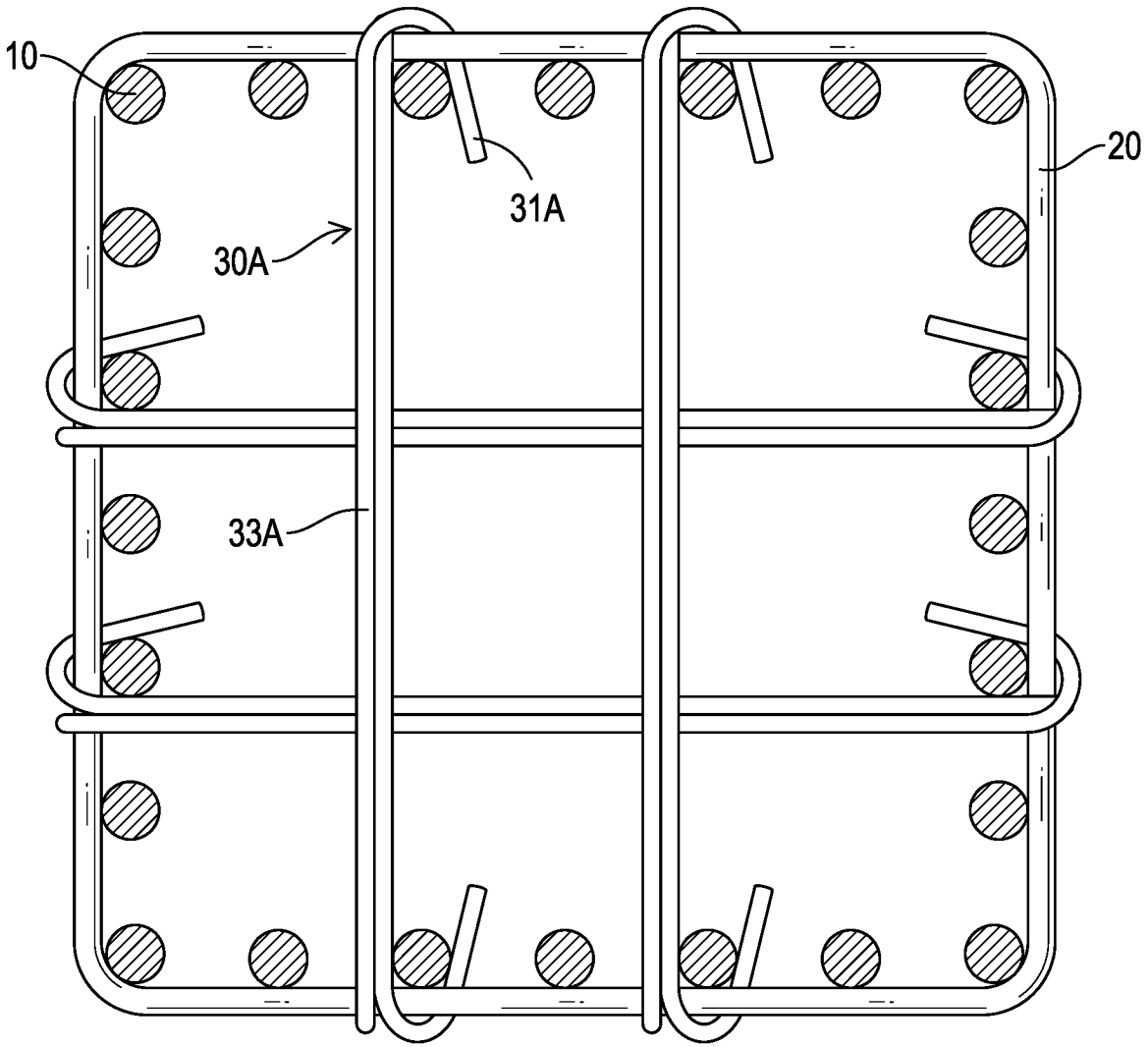
FIG. 7 is a top view of the enhanced non-coplanar double winding reinforcement structure in FIG. 6.

With further reference to FIGS. 2 to 4, in the main reinforcing bars erecting step S1, multiple main reinforcing bars 10 are vertically disposed and are separately arranged annularly.

In the reinforcement stirrup winding step S2, a reinforcement stirrup 20 is horizontally wound around the main reinforcing bars 10. In the preferred embodiment, the main reinforcing bars 10 are arranged in a rectangle, and the reinforcement stirrup 20 is wound in a rectangular shape.

In the crossties double hooking and confining step S3, multiple crossties 30 are prepared. Each of the crossties 30 horizontally extends between two of the main reinforcing bars 10 that are disposed opposite to each other and has a main rod portion 33, a first extension rod 31, and a second extension rod 32. The first extension rod 31 is formed on an end of the main rod portion 33 and is bent relative to the main rod portion 33 at an angle of 135 degrees or 180 degrees. The second extension rod 32 is formed on another end of the main rod portion 33 and is bent relative to the main rod portion 33 at an angle of 90 degrees. A first plane is defined by the main rod portion 33 and the first extension rod 31 and a second plane is defined by the main rod portion 33 and the second extension rod 32. The first plane and the second plane are non-coplanar and intersect at an angle of 45 degrees or 90 degrees. The first extension rod 31 is placed on the reinforcement stirrup 20, is disposed by a lateral side of a corresponding one of the main reinforcing bars 10, and is tilted to be hooked to the corresponding main reinforcing bar 10 and the reinforcement stirrup 20. The second extension rod 32 passes between two of the main reinforcing bars 10 that are disposed next to each other and is hooked to the reinforcement stirrup 20.

Moreover, each two main reinforcing bars 10 that are disposed opposite to each other are provided with two of the crossties 30. The two crossties 30 are reversely disposed, such that the first extension rods 31 of the two crossties 30 are hooked to the two main reinforcing bars 10 that are disposed opposite to each other respectively and to the reinforcement stirrup 20.

With reference to FIGS. 2 to 5, an enhanced non-coplanar double winding reinforcement structure using a first embodiment of the crossties 30 is shown. In each of the crossties 30, the first plane defined by the first extension rod 31 and the main rod portion 33 and the second plane defined by the second extension rod 32 and the main rod portion 33 intersect at an angle of 90 degrees.

Figure 8:
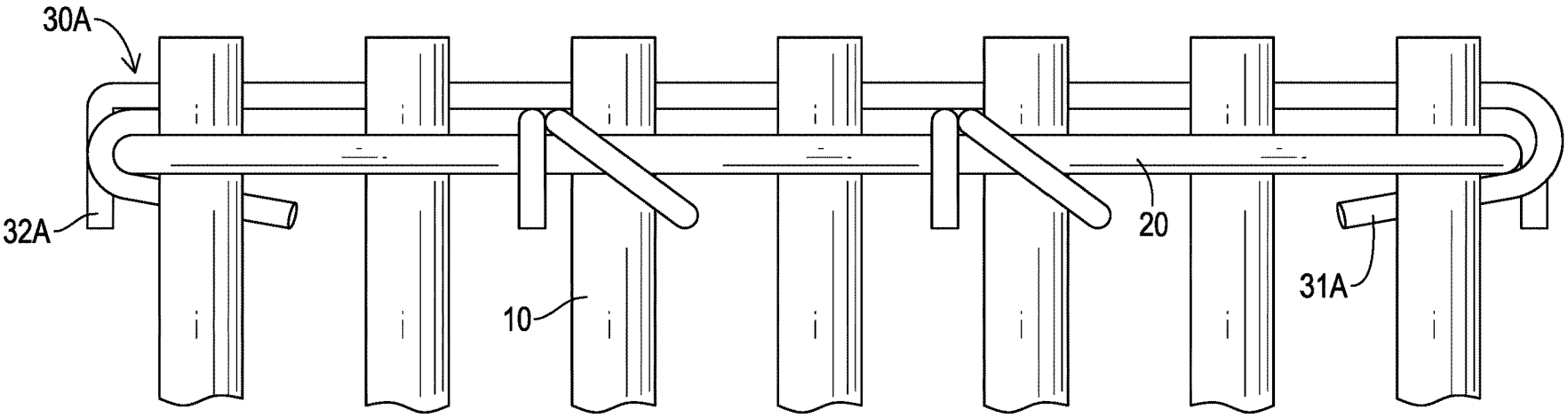
FIG. 8 is a side view of the enhanced non-coplanar double winding reinforcement structure in FIG. 6.
Figure 9:
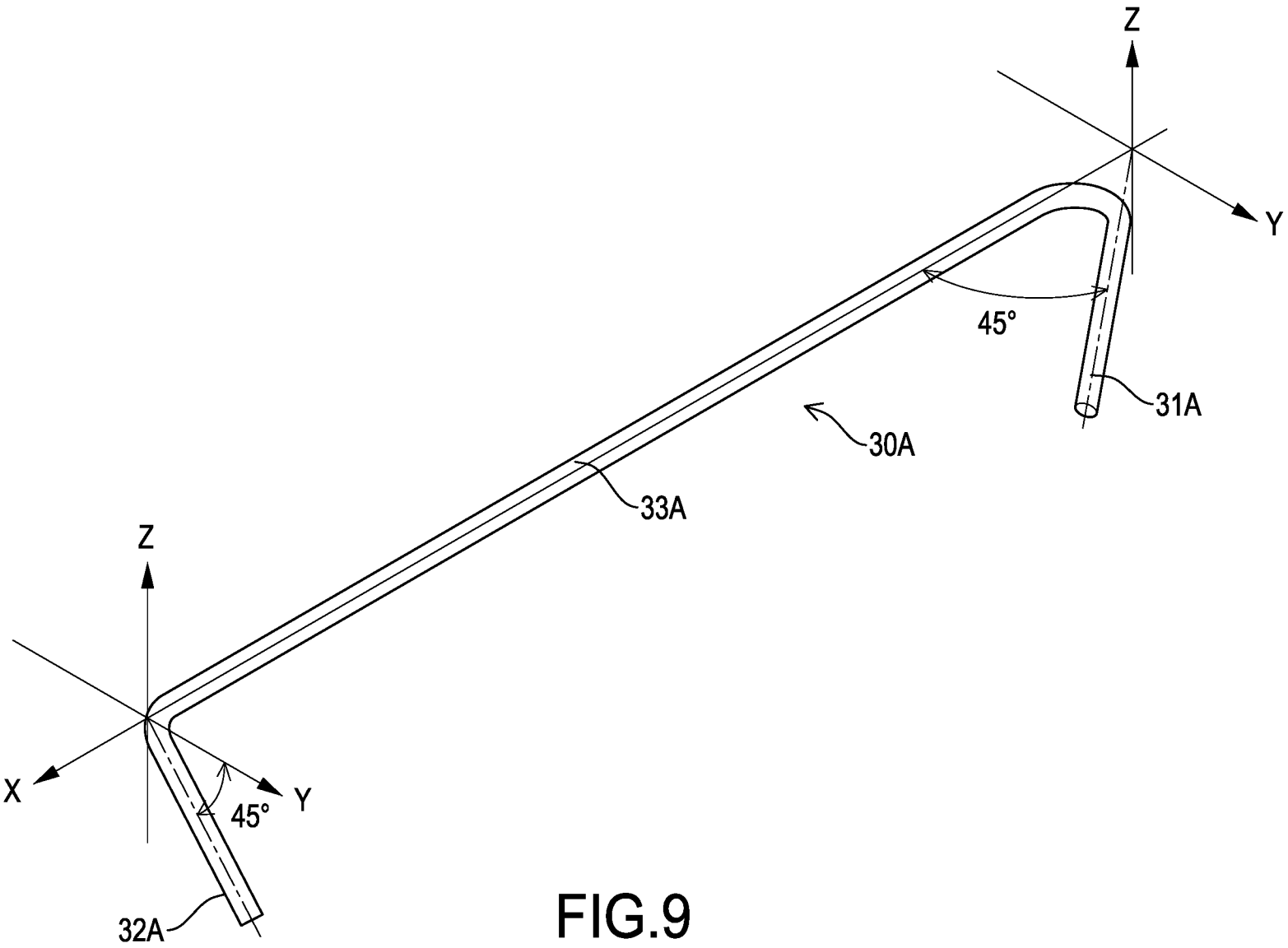
FIG. 9 is a perspective view of the second embodiment of the crosstie used in the enhanced non-coplanar double winding reinforcement structure in FIG. 6.

With further reference to FIGS. 6 to 9, an enhanced non-coplanar double winding reinforcement structure using a second embodiment of the crossties 30A is shown. In each of the crossties 30A, the first plane defined by the first extension rod 31A and the main rod portion 33A and the second plane defined by the second extension rod 32A and the main rod portion 33A intersect at an angle smaller than 90 degrees. Specifically, as shown in FIG. 9, the first plane and the second plane intersect at an angle of 45 degrees.

Figure 10:
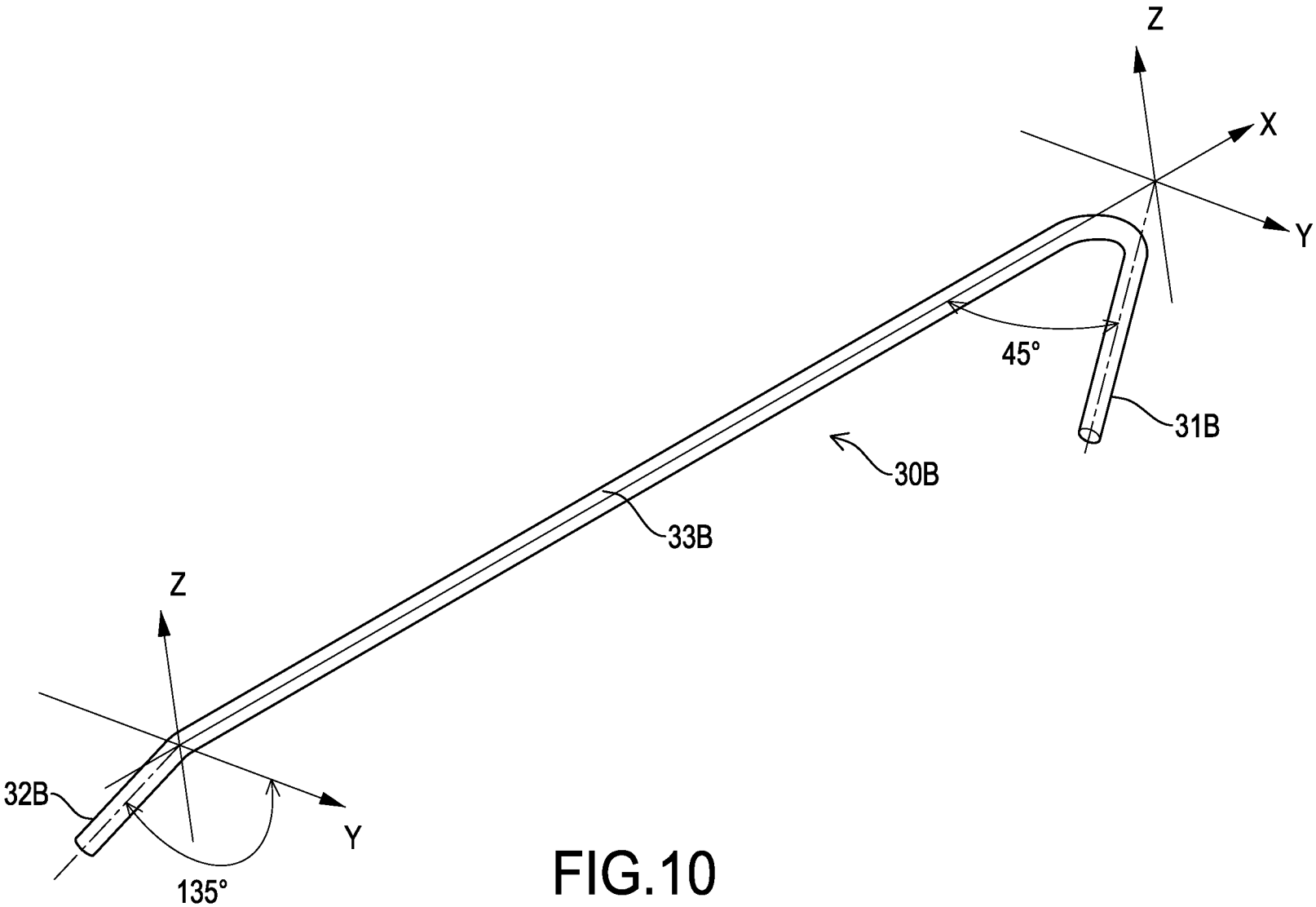
FIG. 10 is a perspective view of a third embodiment of the crosstie used in an enhanced non-coplanar double winding reinforcement structure.
Figure 11:
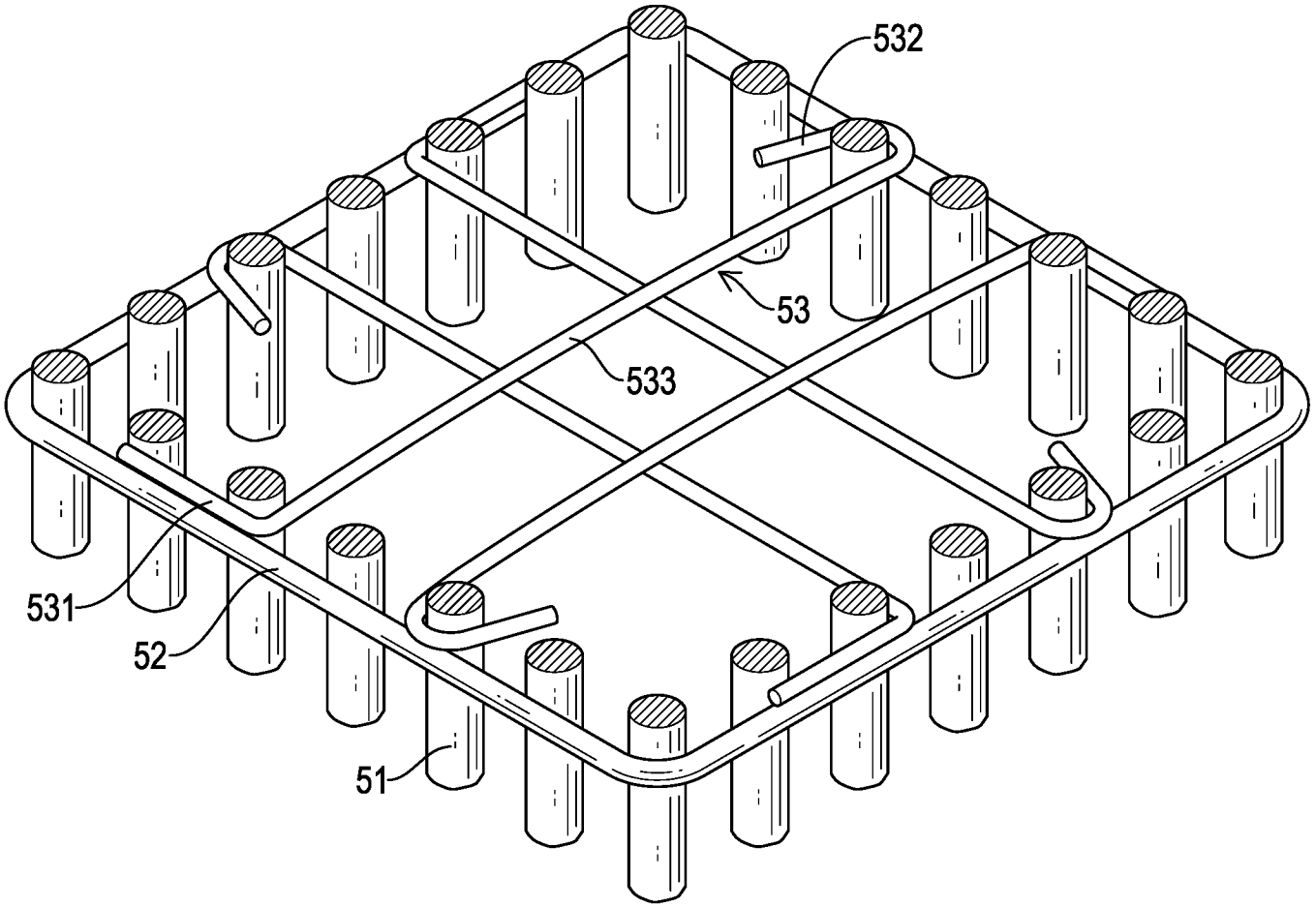
FIG.11 PRIOR ART
FIG. 11 is an enlarged perspective view of a conventional coplanar single winding reinforcement structure in accordance with the prior art.
Figure 12:
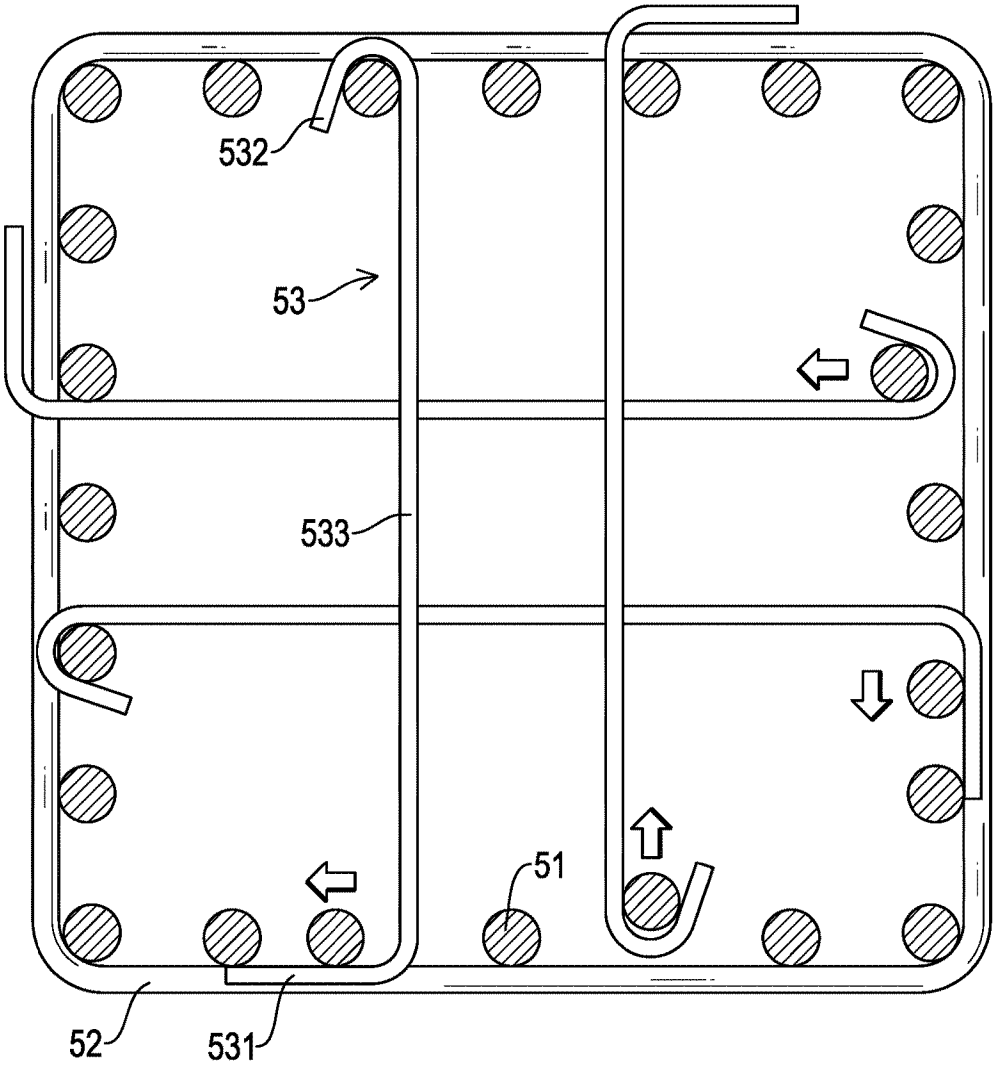
FIG.12 PRIOR ART
FIG. 12 is a top view of the conventional coplanar single winding reinforcement structure in FIG. 11.
Figure 13:
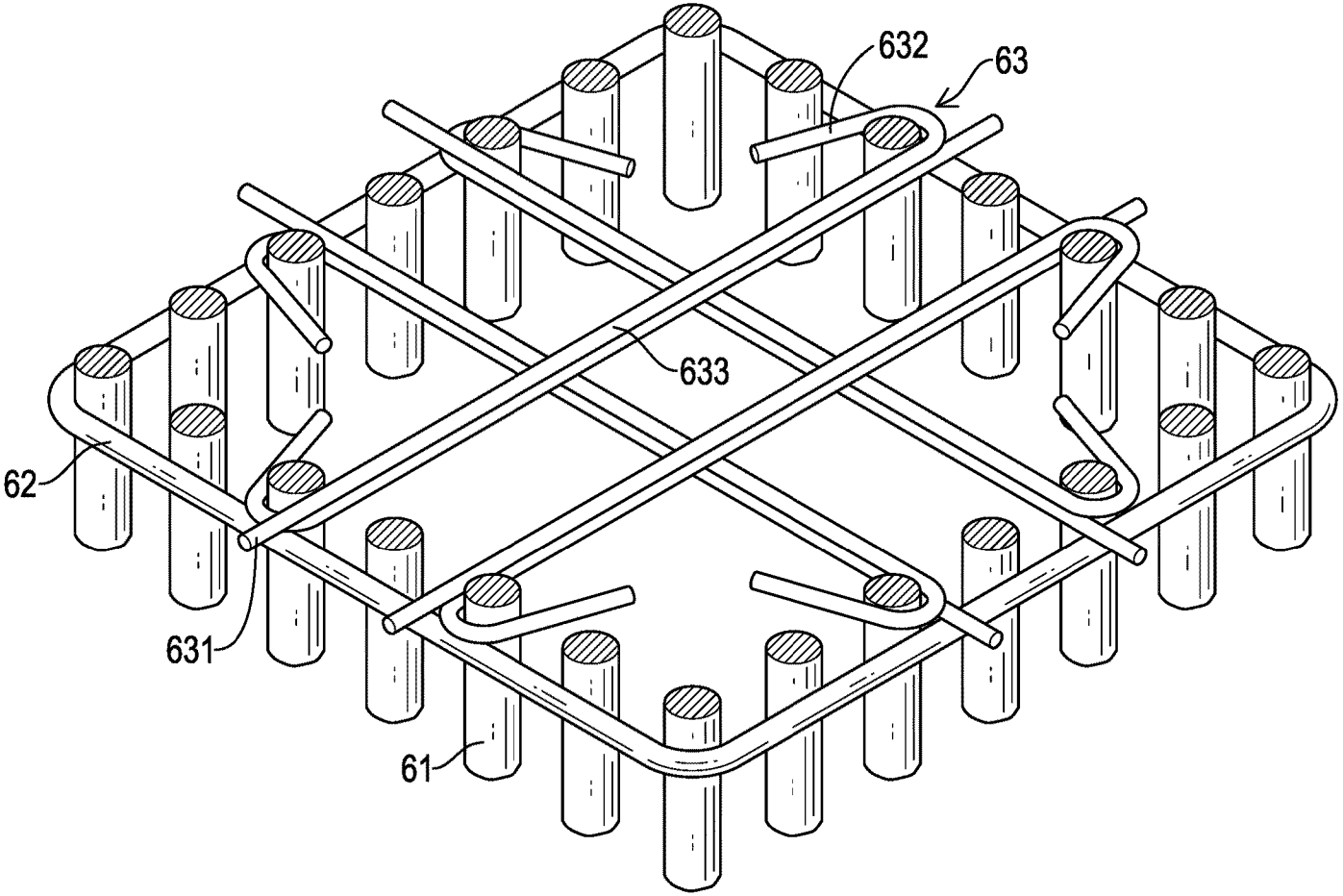
FIG.13 PRIOR ART
FIG. 13 is an enlarged perspective view of a conventional double winding reinforcement structure in accordance with the prior art.

With further reference to FIG. 10, an enhanced non-coplanar double winding reinforcement structure using a third embodiment of the crossties 30B is shown. In each of the crossties 30B, the first plane defined by the first extension rod 31B and the main rod portion 33B and the second plane defined by the second extension rod 32B and the main rod portion 33B intersect at an angle larger than 90 degrees. Specifically, as shown in FIG. 10, the first plane and the second plane intersect at an angle of 135 degrees.

Since the first extension rod 31, 31A, 31B of each crosstie 30, 30A, 30B is hooked to the reinforcement stirrup 20 and the corresponding main reinforcing bar 10 at the same time, a stable and full confinement effect can be formed. Moreover, with the second extension rod 32, 32A, 32B of each crosstie 30, 30A, 30B forming a 90-degree half confinement effect on the corresponding main reinforcing bar 10, the crosstie 30, 30A, 30B is able to be stably hooked to the reinforcement stirrup 20 and two of the main reinforcing bars 10 that are disposed opposite to each other and does not fall off easily. Thus, no iron wire is needed for bundling. Therefore, the first extension rod 31, 31A, 31B and the second extension rod 32, 32A, 32B of each crosstie 30, 30A, 30B form a total of three confinement, such that toughness and aseismatic capability of the enhanced non-coplanar double winding reinforcement structure is improved. Accordingly, construction steps are simplified and construction efficiency are increased.

In addition, as shown in FIGS. 8, 9, and 10, since the first plane defined by the main rod portion 33, 33A, 33B and the first extension rod 31, 31A, 31B of the crosstie 30, 30A, 30B and the second plane defined by the main rod portion 33, 33A, 33B and the second extension rod 32, 32A, 32B of the crosstie 30, 30A, 30B intersect at the angle of 45 degrees or 90 degrees, the second extension rod 32, 32A, 32B can pass between two of the main reinforcing bars 10 that are disposed next to each other. Thus, the crosstie 30, 30A, 30B in accordance with the present invention can be used for confining the main reinforcing bars 10 that are densely arranged.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An enhanced non-coplanar double winding reinforcement method comprising steps of:

a main reinforcing bars erecting step, wherein multiple main reinforcing bars are vertically disposed and are separately arranged annularly;

a reinforcement stirrup winding step, wherein a reinforcement stirrup is horizontally wound around the main reinforcing bars; and a crossties double hooking and confining step, wherein multiple crossties are prepared, each of the crossties has a main rod portion, a first extention rod formed on an end of the main rod portion and bent relative to the main rod portion and a second extention rod formed on another end of the main rod portion and bent relative to the main rod portion, and a first plane defined by the main rod portion and the first extention rod and a second plane defined by the main rod portion and the second extension rod intersect and are non-coplanar, and wherein the first extention rod is placed on the reinforcement stirrup, is disposed by a lateral side of a corresponding one of the main reinforcing bars and is tilted to be hooked to the corresponding main reinforcing bar and the reinforcement stirrup, and the second extension rod passes between two of the main reinforcing bars that are disposed next to each other and is hooked to the reinforcement stirrup.

2. The enhanced non-coplanar double winding reinforcement method as claimed in claim 1, wherein in the crossties double hooking and confining step, the first extension rod of each crosstie is bent at an angle of 135 degrees or 180 degrees and the second extension rod of each crosstie is bent at an angle of 90 degrees.

3. The enhanced non-coplanar double winding reinforcement method as claimed in claim 1, wherein in the crossties double hooking and confining step, each two main reinforcing bars that are disposed opposite to each other are provided with two of the crossties, and the first extension rods of the two crossties are hooked to the two main reinforcing bars that are disposed opposite to each other respectively and to the reinforcement stirrup.

4. The enhanced non-coplanar double winding reinforcement method as claimed in claim 2, wherein each two main reinforcing bars that are disposed opposite to each other are provided with two of the crossties, and the first extension rods of the two crossties are hooked to the two main reinforcing bars that are disposed opposite to each other respectively and to the reinforcement stirrup.

5. An enhanced non-coplanar double winding reinforcement structure comprising:

multiple main reinforcing bars, each of the main reinforcing bars vertically disposed, and the main reinforcing bars separately arranged annularly;

a reinforcement stirrup horizontally wound around the main reinforcing bars; and multiple crossties, each of the crossties having a main rod portion;

a first extension rod formed on an end of the main rod portion and bent relative to the main rod portion; and a second extension rod formed on another end of the main rod portion and bent relative to the main rod portion;

wherein a first plane defined by the main rod portion and the first extension rod and a second plane defined by the main rod portion and the second extension rod intersect and are non-coplanar; and the first extension rod of each crosstie is placed on the reinforcement stirrup, is disposed by a lateral side of a corresponding one of the main reinforcing bars and is tilted to be hooked to the corresponding main reinforcing bar and the reinforcement stirrup, and the second extension rod of each crosstie passes between two of the main reinforcing bars that are disposed next to each other and is hooked to the reinforcement stirrup.

6. The enhanced non-coplanar double winding reinforcement structure as claimed in claim 5, wherein the first extension rod of each crosstie is bent at an angle of 135 degrees or 180 degrees; and the second extension rod of each crosstie is bent at an angle of 90 degrees.

7. The enhanced non-coplanar double winding reinforcement structure as claimed in claim 5, wherein each two main reinforcing bars that are disposed opposite to each other are provided with two of the crossties, and the first extension rods of the two crossties are hooked to the two main reinforcing bars that are disposed opposite to each other respectively and to the reinforcement stirrup.

8. The enhanced non-coplanar double winding reinforcement structure as claimed in claim 6, wherein each two main reinforcing bars that are disposed opposite to each other are provided with two of the crossties, and the first extension rods of the two crossties are hooked to the two main reinforcing bars that are disposed opposite to each other respectively and to the reinforcement stirrup.

9. A crosstie for an enhanced non-coplanar double winding reinforcement method, and the crosstie having a main rod portion;

a first extension rod formed on an end of the main rod portion and bent relative to the main rod portion; and a second extension rod formed on another end of the main rod portion and bent relative to the main rod portion;

wherein a first plane defined by the main rod portion and the first extension rod and a second plane defined by the main rod portion and the second extension rod intersect and are non-coplanar.

10. The crosstie as claimed in claim 9, wherein the first extension rod of each crosstie is bent at an angle of 135 degrees or 180 degrees; and the second extension rod of each crosstie is bent at an angle of 90 degrees.

11. The crosstie as claimed in claim 9, wherein the first plane defined by the first extension rod and the main rod portion and the second plane defined by the second extension rod and the main rod portion intersect at an angle larger than 90 degrees.

12. The crosstie as claimed in claim 10, wherein the first plane defined by the first extension rod and the main rod portion and the second plane defined by the second extension rod and the main rod portion intersect at an angle larger than 90 degrees.

13. The crosstie as claimed in claim 9, wherein the first plane defined by the first extension rod and the main rod portion and the second plane defined by the second extension rod and the main rod portion intersect at an angle of 90 degrees.

14. The crosstie as claimed in claim 10, wherein the first plane defined by the first extension rod and the main rod portion and the second plane defined by the second extension rod and the main rod portion intersect at an angle of 90 degrees.

15. The crosstie as claimed in claim 9, wherein the first plane defined by the first extension rod and the main rod portion and the second plane defined by the second extension rod and the main rod portion intersect at an angle smaller than 90 degrees.

16. The crosstie as claimed in claim 10, wherein the first plane defined by the first extension rod and the main rod portion and the second plane defined by the second extension rod and the main rod portion intersect at an angle smaller than 90 degrees.

* * * * *